United States Patent [19]

Grandell

[11] 4,334,418

[45] Jun. 15, 1982

[54] PORTABLE STRIP STEEL CAMBER STRAIGHTENING MACHINE

[75] Inventor: William A. Grandell, Oak Lawn, Ill.

[73] Assignee: Siegrand Corporation, Chicago, Ill.

[21] Appl. No.: 169,976

[22] Filed: Jul. 18, 1980

[51] Int. Cl.[3] ..... B21D 3/02

[52] U.S. Cl. ..... 72/164; 72/183; 140/147

[58] Field of Search ..... 72/164, 160, 183, 165, 72/199; 140/147

[56] References Cited

U.S. PATENT DOCUMENTS

| | | | |
|---|---|---|---|
| 962,831 | 6/1910 | Haga | 72/164 |
| 1,914,975 | 6/1933 | Nigro | 72/164 |
| 2,746,513 | 5/1956 | Kiesow et al. | 72/164 |
| 2,984,285 | 5/1961 | Simich et al. | 72/165 |
| 3,328,995 | 7/1967 | Rohlfs | 72/164 X |
| 3,438,231 | 4/1969 | Petzschke | 72/160 |
| 3,595,277 | 7/1971 | Lefever | 72/164 X |

*Primary Examiner*—Francis S. Husar
*Assistant Examiner*—Jonathan L. Scherer
*Attorney, Agent, or Firm*—Silverman, Cass & Singer

[57] ABSTRACT

The machine has a base provided with three rollers between which cambered strip steel is passed to remove or reduce the camber therein. Two of the rollers are mounted extending above the top surface of the base along a longitudinal axis of the base. The third roller is mounted also extending above said top surface on a block which is slidable along a slot extending along the lateral axis of the base. The cambered strip steel is passed across the top of the base between the three rollers. A drive mechanism is provided to apply a force to the third roller which bends the cambered strip steel against the two rollers to remove or reduce the camber. Removable guide strips of a case hardened or other suitable metal are provided in the top as bearing members for the strip steel. The base may be fabricated of assembled components or cast as an integral member for cost economy.

8 Claims, 9 Drawing Figures

FIG. 4
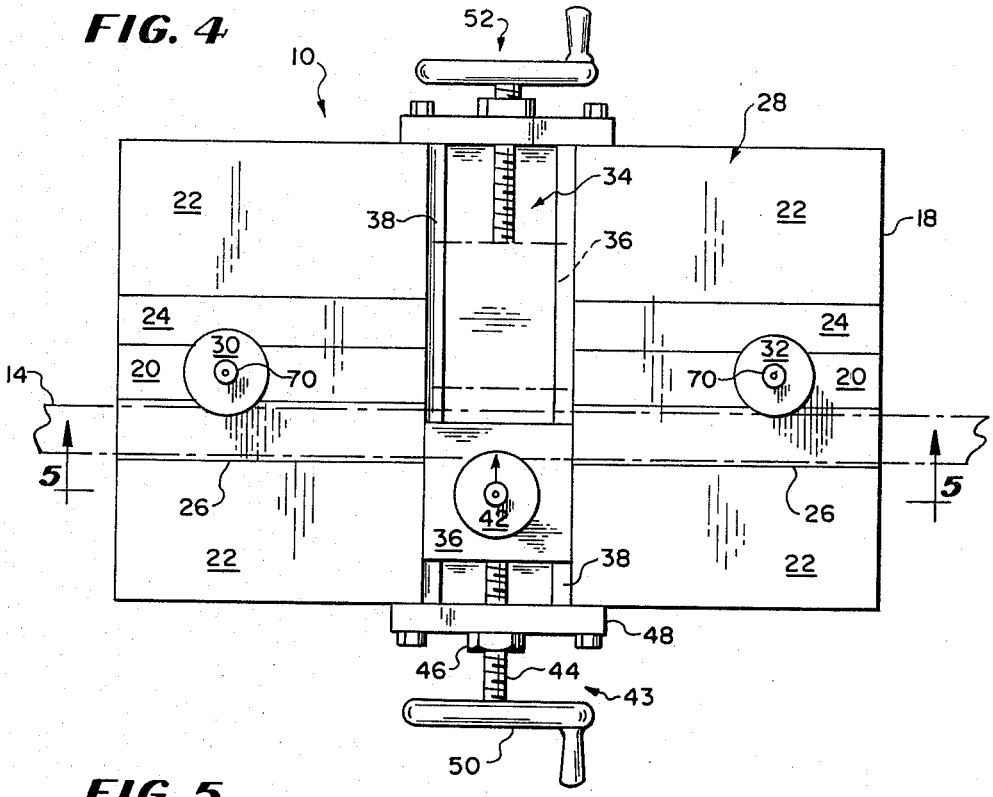
FIG. 5
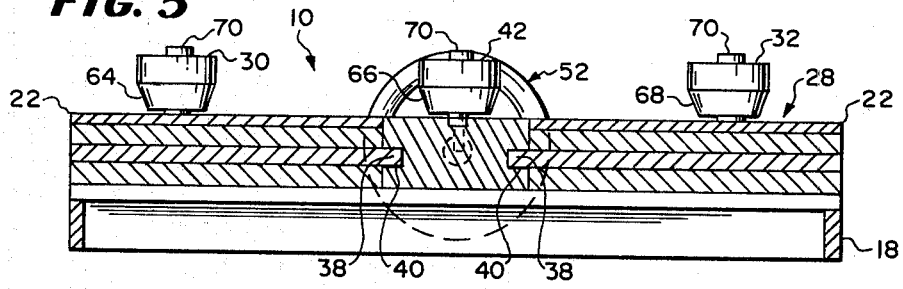
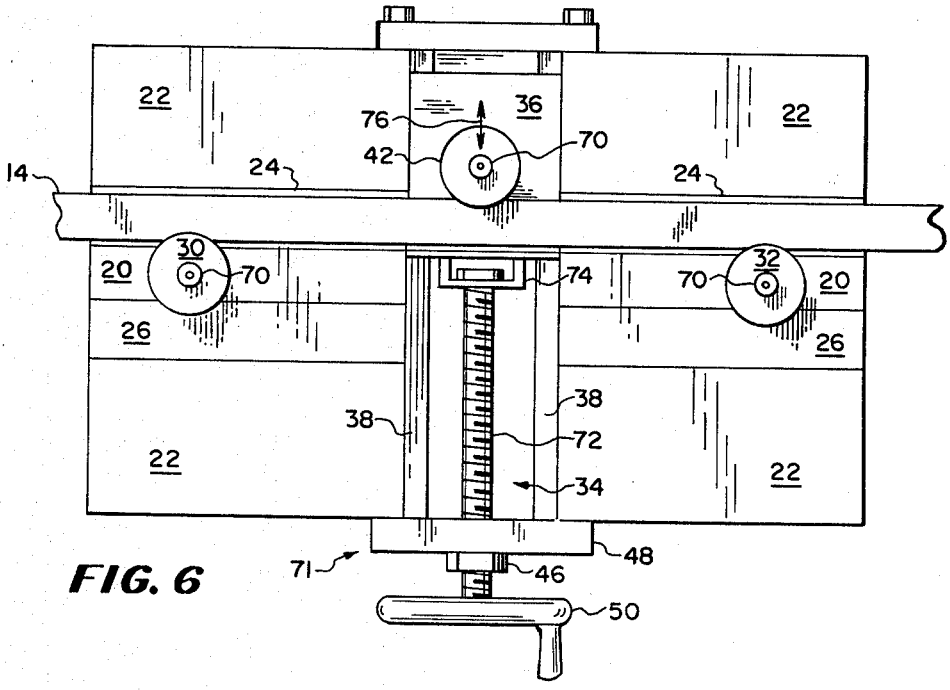
FIG. 6

PORTABLE STRIP STEEL CAMBER STRAIGHTENING MACHINE

BACKGROUND OF THE INVENTION

This invention relates generally to power feeding of strip material and more particularly, relates to a novel machine for straightening the camber of strip steel or like material being power fed to metal working equipment, such as punch presses.

An automatic or other press, such as a punch press, often is continuously supplied with strip material, such as steel, to mass produce one piece part. The press is provided with a die which punches the same part from the web of strip steel as the web is fed through the press. The web of strip steel usually is fed to the press from a power driven coil of the material obtained from a supplier. The power driving mechanism rotates the coil for unwinding the strip material for feeding to the press.

This strip material coming off the coil's circumference frequently has a camber which hampers or even prevents the power feeding of the strip material from the coil to the press. Camber is that condition of strip material wherein the strip material will curve to the right or left when placed on a planar surface. Camber is defined as the deviation of a side edge of the material from a straight line and may be measured by placing an eight foot straight edge against the concave edge of the material. The distance between the straight edge and concave edge of the material is the quantified camber of the material.

Some camber can be tolerated by the die of a punch press. Many times, however, the camber of the strip material is great enough to prevent the material from entering the die or cause jamming of the material entering the die. This results in material that cannot be used for its intended application; such material must be scrapped, often at a substantial monetary loss.

The invention herein provides a novel machine constructed to remove or reduce the camber of the strip material concurrently with the strip material being fed to the die of the press. The machine of the present invention is located between the coil and the press. The cambered strip material is power fed through the machine and has its camber removed or reduced to an acceptable degree before entering the punch press, for instance. The strip material which exits from the machine thus is in a condition which is readily useable by the press die.

Other devices for straightening elongate materials are known. For example, U.S. Pat. No. 2,492,491 discloses a pipe bending vice; U.S. Pat. No. 2,278,353 discloses a rod straightener; and U.S. Pat. No. 2,232,724 discloses a rail bender. In these patents, elongate materials, such as pipe, rod and railroad rails, are bent or straightened. The devices disclosed perform the bending or straightening by applying a force to the material between two fixed supports.

However, all of these devices provide for stationary and intermitent operation. The material to be bent or straightened is not continuously passed through the device. U.S. Pat. No. 2,492,491 provides a device which grips the pipe stationary in a vise for bending at individual locations. U.S. Pat. No. 2,278,353 provides a device where a shaft of a farm machine may be straightened without removing the shaft from the machine. U.S. Pat. No. 3,232,724 provides a rail straightener with jaws engaging the rail to prevent breakage of the straightener. All of these devices provide for holding the material stationary while the material is bent or straightened at individual locations.

The machine embodying the invention operates to continuously remove camber from a web of strip metal along the entire length of the web concurrently with the strip material passing through the machine. The strip material is not successively straightened at individual adjacent sections as it is fed to the press; rather it is continuously straightened concurrently with its being fed to the press. This provides for desirable continuous feeding of camber straightened strip material to the press so that an uninterrupted, rapid rate of stamping of parts can be maintained.

The machine embodying the invention further is provided with bearing members which are replaceable. Thus, an inexpensive base made of a soft metal may be used which need not be replaced due to wear caused by hard or hardened strip material.

The machine embodying the invention is portable and uncomplicated and is adjusted easily for different widths and heights of strip material and for different amounts of camber.

SUMMARY OF THE INVENTION

A portable machine for straightening cambered strip material includes a base having an essentially planar top surface with a longitudinal axis and a lateral axis. Two or a pair of guide rollers are mounted on the base spaced above said top surface along the longitudinal axis and on opposite sides of the lateral axis. A third roller is mounted on the base spaced above the top surface and which is movable along the lateral axis. All three rollers have axes of rotation oriented substantially normal to the top surface. The strip material is passed across the top of the machine between the rollers. Drive means are provided for moving the third roller along the lateral axis to engage the cambered strip material between the two guide rollers and the third roller. The drive mechanism further is able to provide a force exertable by the third roller sufficient to bend or curve the material between the three rollers and reduce or remove the camber therefrom.

The term "longitudinal axis" is used herein to mean a straight line extending across the top of the camber straightening machine parallel to the direction of movement of the strip material through the camber straightening machine. This "longitudinal axis" is taken along the length of the machine, i.e., from the ends of the machine at which the strip material enters and exists respectively. The term "lateral axis" is used herein to mean a line normal to said longitudinal axis or normal to the line on which the first mentioned pair of guide rollers rotatably are mounted. It should be understood that these terms do not refer to axis of the base which does not rotate or move during operation of the machine.

Further, the so-called "third roller", which is a pressure or force exerting roller in operation can be oriented in its rotation on opposite sides of said longitudinal axis, as desired by the operator.

Additionally, the straightening machine is provided with removable guide strips upon which the strip material bears as the material passes through the machine. These guide strips may be removed and replaced as they are worn by the material so that the entire machine does not have to be replaced. Further the rollers are provided with frustum-shaped portions with the narrowest portion of the frustum located adjacent the top surface so as to urge the strip material against the top surface of the base.

BRIEF DESCRIPTION OF THE DRAWINGS

FIG. 4 is a top plan view of said machine illustrating both the strip steel and a mounting block in broken lines;

FIG. 5 is a sectional view taken through the machine along the line 5—5 of FIG. 4 and in the direction indicated by the arrows;

FIG. 6 is a top plan view of a modified embodiment of the said machine illustrating one drive mechanism and the strip steel;

DESCRIPTION OF THE PREFERRED EMBODIMENT

Figure 1:
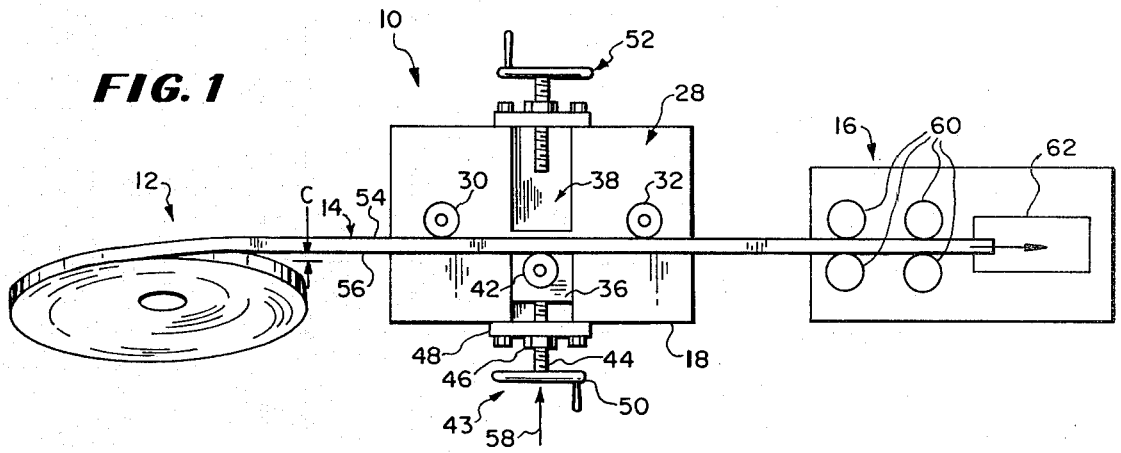
FIG. 1 is a diagrammatic view of the camber straightening machine embodying the invention shown illustratively in a power-fed punch press set-up including a mounted coil of cambered strip steel and a punch press.

Referring now to FIG. 1, there is shown a camber straightening machine embodying the invention indicated generally by the reference character 10. Straightening machine 10 is shown located between a coil 12 of strip material 14 and a press 16. Strip material 14 has a camber C as it is fed from coil 12 to straightening machine 10. The camber C is reduced or removed by straightening machine 10 and, effectively, is no longer present as the strip material 14 enters the press 16. The set-up illustrated is for diagrammatical purposes to show how the machine embodying the invention can be of a portable character since it is separately positioned relative to coil 12 and press 16.

Figure 2:
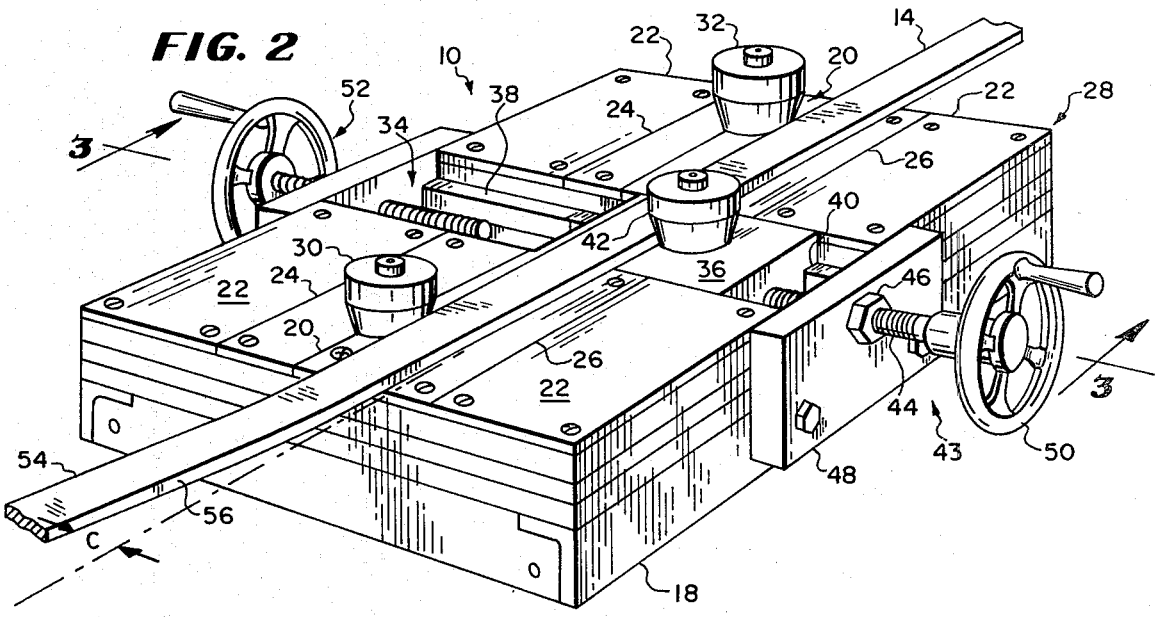
FIG. 2 is a perspective view of the machine of the invention illustrating a web of strip steel passing therethrough.

Referring to FIG. 2, straightening machine 10 includes a base 18 which may be fabricated from individual component parts assembled together or formed otherwise as will be explained for another embodiment. Base 18 includes center hold-down plates 20 and outside hold-down plates 22. Base 18 further includes guide strips 24 and 26 located between the center hold-down plates 20 and the outside hold-down plates 22. Hold-down plates 20 and 22 and guide strips 24 and 26 are suitably secured by fasteners and serve to form an essentially planar top 28 of base 18 across which the strip material 14 is passed. Guide strips 24 and 26 additionally serve as removable bearing members for the strip material 14. Thus, only the guide strips 24 and 26 need be replaced due to wear caused by abrasion due to the strip material 14 passing across the top 28 of the base 18 instead of having to replace the entire top or machine.

Two rollers 30 and 32 are mounted to the top 28 along a longitudinal axis of base 18 on center hold-down plates 20. Rollers 30 and 32 are mounted so that their rotational axes are essentially normal to the top 28, the rollers thereby being able to revolve around their rotational axis as strip material 14 passes thereagainst.

Base 18 further is provided with a guideway or track 34 extending along the lateral axis of base 18. A block 36 is mounted in track 34 for sliding movement along the track. A lip 38 engages with a groove 40 of block 36 to maintain block 36 in slot 34. A third roller 42 is fixed on block 36 and has a rotational axis essentially normal to top 28. Thus, roller 42 also may revolve around its rotational axis as strip material 14 passes thereagainst across top 28.

Block 36 is movable along track or slot 34 in one direction by a drive mechanism 43 including drive screw 44 operating against a jam nut 46 fixed in a drive plate 48 which is fastened to base 18. Drive screw 44 is rotated by an adjusting wheel 50 which may be manually operated. A like drive mechanism 52 exists on the side of base 18 opposite drive mechanism 43, which serves to move block 36 along slot 34 in the opposite direction.

Referring to FIG. 1, strip material 14 includes a lateral concave edge 54 and a lateral convex edge 56. Strip material 14 is fed through machine 10 with concave edge 54 engaged against rollers 30, 32 and with convex edge 56 engaged against roller 42. Thus, a pressure applied through drive screw 44 and roller 42 in the direction indicated by arrow 58 serves to reduce or remove the camber C in strip material 14 by bending or curving strip material 14 against rollers 30, 32. The material that exits machine 10 and enters press 16 thus has any camber removed or significantly reduced. Strip material 14 then may easily pass through entrance rollers 60 of press 16 and properly enter die 62.

FIG. 1 illustrates how straightening machine 10 may be used in a power-fed press arrangement to remove camber from a coil of strip material concurrently with the material passing through the straightening machine as the material is being power-fed to a press.

Figure 3:
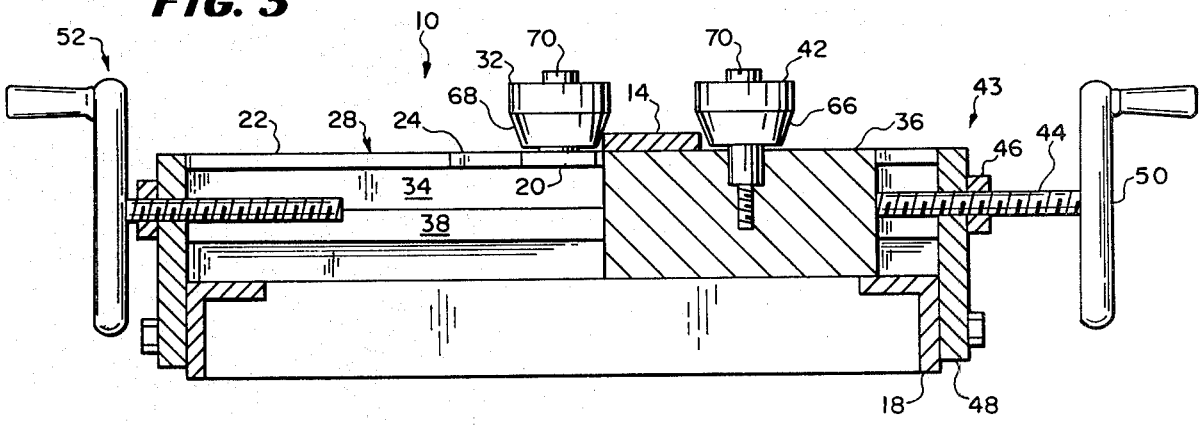
FIG. 3 is a sectional view taken through the machine generally along the line 3—3 of FIG. 2 and in the general direction indicated.

FIG. 3 illustrates more particularly that rollers 32 and 42 respectively are mounted above top 28 and block 36, essentially at the same level. This is further illustrated in FIG. 5.

FIGS. 3 and 5 further illustrate that rollers 30, 32 and 42 are generally of cylindrical form but have respective lower portions 64, 66 and 68 which essentially have the shape of a frustum with the narrowest part of the taper being adjacent top 28 and block 36. These lower portions are engaged against strip material 14 and serve to retain strip material 14 against top 28 as it passes through machine 10. Thus, strip material 14 is prevented from rising out of machine 10 as it passes therethrough. Rollers 30, 32 and 42 are mounted on top 28 and block 36 by fasteners such as shoulder bolts 70 passing through the rotational axes thereof.

As seen in FIG. 4, strip material 14, shown in broken lines, overlays guide strips 26 as material 14 passes between rollers 30, 32 and 42. The block 36, indicated in broken lines, is in a position along slot 34 where it is engaged with drive mechanism 52. The block 36 may be urged toward the center of slot 34 by either drive mechanism 43 or drive mechanism 52.

FIG. 5 illustrates how straightening machine 10 may be fabricated from individual parts and further illustrates the relationship of lips 38 and grooves 40 wherein lips 38 are located in the grooves 40.

FIG. 6 illustrates an embodiment of the invention in which a single drive mechanism 71 is provided for block 36. In this embodiment, an elongate drive screw 72 is mounted at one end thereof to block 36 by bracket 74. The other end of elongate drive screw 72 carries adjusting wheel 50 with screw 72 passing through jam nut 46. With elongate drive screw 72 and bracket 74, block 36 may be moved in both directions indicated by arrow 76 along slot 34 by rotating wheel 50 clockwise or counterclockwise. Thus, while in FIG. 4 two drive mechanisms are required to selectively apply a force against strip material 14 from opposite sides of rollers 30, 32, in FIG. 6, only a single drive mechanism is needed to perform the same function. This is illustrated in FIG. 6 where strip material 14 is located on a side of rollers 30, 32 opposite that illustrated in FIG. 4. It may also be noted in FIG. 6 that strip material 14 bears on guide strips 24 and not guide strips 26.

Machine 10 may be made of any material desired and in the preferred embodiment, base 18 and top 28 are made of aluminum with guide strips 24 and 26 being made of brass. Machine 10 thus is made of lightweight material with guidestrips 24 and 26 being readily replaceable in response to wear caused by the abrasion of strip material 14 sliding thereacross. In a preferred embodiment, machine 10 has a length of 16 inches, a width of 10 inches, and a height of about 3 inches. Such a machine is readily portable and may be moved from press set-up to press set up as is needed to provide camber straightening.

It has been explained in regard to FIG. 1 that coil 12 is power-driven to feed strip material to press 16. In such an installation, machine 10 could be secured, by some external means not illustrated, against the drive force feeding strip material 14 through machine 10. This securing may be provided as is desired.

Figure 7:
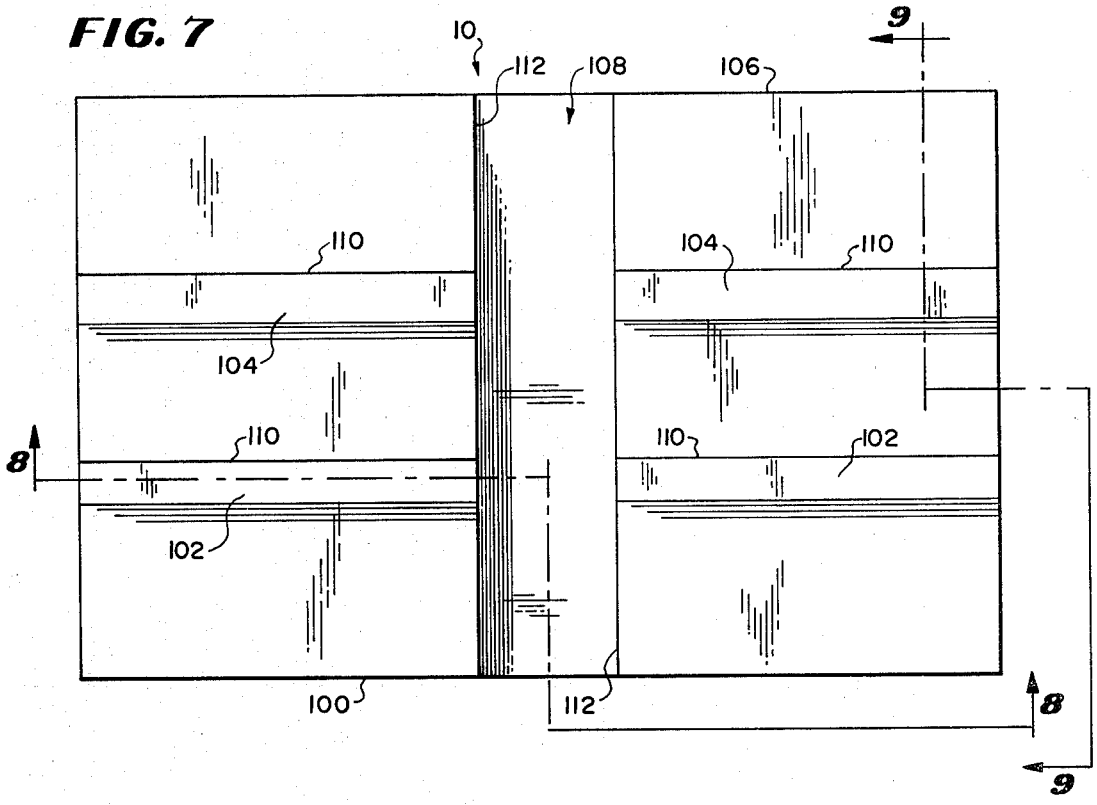
FIG. 7 is a top plan view of a third embodiment of the invention in which the base of the straightening machine is cast.
Figure 8:
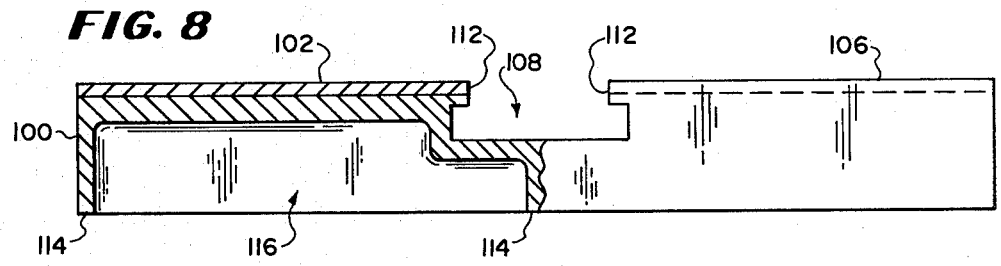
FIG. 8 is a partial sectional view of a side of the embodiment illustrated in FIG. 7 taken generally along the line 8—8 of FIG. 7 in the direction indicated by the arrows.
Figure 9:
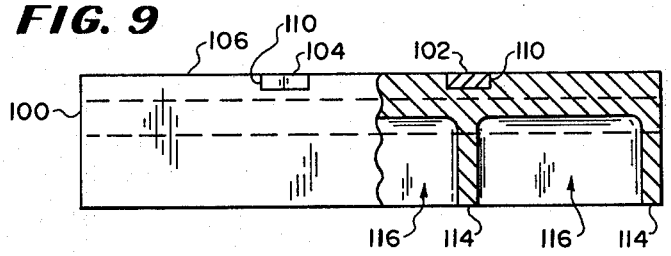
FIG. 9 is a partial sectional view of the rear end of the embodiment illustrated in FIG. 7 taken generally along the line 9—9 of FIG. 7 in the direction indicated by the arrows.

FIGS. 7, 8 and 9 illustrate an embodiment of the invention in which the base is formed as a unitary structure, such as by casting or otherwise. In this embodiment, straightening machine 10 includes a generally rectangular base 100 and removable guide strips 102 and 104.

Base 100 is formed as a unitary structure to include top 106 and slot 108 extending along a lateral axis thereof. Guide strips 102 and 104 are mounted in grooves 110, with grooves 110 being formed in top 106 and extending essentially parallel to the longitudinal axis of base 100.

Slot 108 is generally rectangular in cross section and is formed with lips 112 extending from the walls thereof adjacent top 106. This is in contrast to lips 38 which extend from the walls of slot 34 midway down the walls thereof. Of course, lips 38 and 112 may be located along the walls of the slot, as desired.

Base 100 further includes ribs 114 extending down from top 106 to reinforce the base 100, between which chambers 116 are formed. Base 100 preferably is made of cast aluminum with guide strips 102 and 104 again being made of brass or other suitably hard bearing material.

In FIGS. 7, 8 and 9, a drive mechanism or mechanisms, rollers and mounting block are not illustrated for purposes of maintaining the figures simplified. These elements normally would be mounted on base 100 in a manner similar to that already described in connection with the prior embodiments and function in the same manner.

Modifications and variations of the present invention are possible in light of the above teachings. For example, it is possible that the third roller could be mounted fixed to the top and the first two rollers could be movable laterally across the top relative to the third roller. It therefore should be understood that the invention may be practiced otherwise than as specifically described within the purview of the appended claims.

What is desired to be secured by Letters Patent of the United States is:

1. A portable machine for straightening cambered strip material passing therethrough as a continuous web, the cambered strip material having two opposed lateral edges and being concave along one of the two edges, the machine comprising:

a. a base providing a substantially planar top having a longitudinal axis and a lateral axis, a guideway or slot extending along the lateral axis;

b. at least a pair of guide rollers mounted on the top aligned along said longitudinal axis and at a level spaced above the top, the rollers of the pair being on opposite sides of the lateral axis and being engageable with the concave one of said edges, the pair of rollers being rotatable around rotational axes normal to the top;

c. a mounting block slidable along the slot and a third guide roller fixedly mounted on the block and movable with the block along the lateral axis at the same level as the two guide rollers and being engageable with the opposite lateral edge, the third guide roller being rotatable around a rotational axis normal to the top, and being selectively adjustable in position on opposite sides of said longitudinal axis; and d. means for selectively moving the third guide roller relative to the guide roller pair into engagement with said opposite lateral edge so that the strip material is retained between the pair of guide roller and the third guide roller, said means serving to maintain the third guide roller frictionally engaged against said opposite edge sufficiently to bend the strip material against the camber and remove the camber as the strip material passes through the machine between the guide rollers.

2. The machine as claimed in claim 1 and including removable guide strips mounted on said top substantially parallel to the longitudinal axis of the base, the guide strips being formed of a hard metal material and arranged relative to the rollers so that the strip material bears essentially only on the guide strips as the strip material passes through the machine, the guide strips providing bearing surfaces for the strip material.

3. The machine as claimed in claim 1 and including removable guide strips mounted on said top substantially parallel to the longitudinal axis of the base, the guide strips being formed of a hard metal material and arranged relative to the rollers so that the strip material bears essentially only on the guide strips as the strip material passes through the machine, the guide strips providing bearing surfaces for the strip material, and there are guide strips on both sides of the longitudinal axis.

4. The machine as claimed in claim 1 in which the pair of guide rollers are fixed in position relative to the base during machine operation.

5. The machine as claimed in claim 4 in which the third roller moving means include two drive screws mounted on the base and extending into the slot along the lateral axis for rotational movement, there being one screw on either side of the longitudinal axis of the base, the drive screws having two opposed ends, one end being engageable with the mounting block and the other end extending out of the base and including adjustment means by which the screw may be rotated to bring the one end into engagement with the mounting block and selectively move the block along the slot to positions on opposite sides of the longitudinal axis, the screw being rotatable so as to maintain the third roller against the strip material with sufficient force for straightening the cambered edge.

6. The machine as claimed in claim 4 in which the third roller moving means includes a single drive screw mounted on the base and extending into the slot along the lateral axis for rotational movement, the screw being extendable beyond the longitudinal axis and having two opposed ends, one end being rotationally mounted to the mounting block and the other end extending out of the base and including adjustment means by which the drive screw may be rotated to selectively move the mounting block along the slot, the screw being rotatable so as to maintain on both sides of the longitudinal axis the third roller against the strip material with said force for straightening the cambered edge.

7. The machine as claimed in claim 1 in which the rollers include portions adjacent the top surface which have the shape of a frustum, the narrowest part of the frustum being adjacent the top surface so that the rollers engage the strip material with the portions and maintain the strip material against the top surface as it passes through the machine.

8. The machine as claimed in claim 1 in which the base and top are of integral cast metal construction.

* * * * *